United States Patent [19]

Prazak, III

[11] Patent Number: 4,678,447

[45] Date of Patent: Jul. 7, 1987

[54] PROCESS OF MANUFACTURING FOR A HIGH-RESOLUTION COLOR CATHODE RAY TUBE

[75] Inventor: Charles J. Prazak, III, Elmhurst, Ill.

[73] Assignee: Zenith Electronics Corporation, Glenview, Ill.

[21] Appl. No.: 743,184

[22] Filed: Jun. 10, 1985

[51] Int. Cl.[4] ..... H01J 9/227

[52] U.S. Cl. ..... 445/45; 445/52; 430/5; 430/23

[58] Field of Search ..... 445/45, 52, 30; 313/407, 408, 482, 286, 292; 430/5, 23

[56] References Cited

U.S. PATENT DOCUMENTS

| | | | |
|---|---|---|---|
| 3,862,830 | 1/1975 | Stern | 65/43 X |
| 4,045,200 | 8/1977 | Salisbury | 65/43 X |
| 4,094,678 | 6/1978 | Palac | 445/47 |
| 4,547,696 | 10/1985 | Strauss | 313/292 |
| 4,593,224 | 6/1986 | Palac | 313/407 |
| 4,595,857 | 6/1986 | Rowe et al. | 313/407 |

*Primary Examiner*—Kenneth J. Ramsey
*Attorney, Agent, or Firm*—Ralph E. Clarke, Jr.

[57] ABSTRACT

An assembly-in-process consisting of three components-in-process is disclosed. The components-in-process comprise, respectively, a faceplate with a sealing area circumscribing a target area including of plurality of first registration-affording V-grooves; secondly, a shadow mask support assembly having a frame ultimately constituting a part of the tube envelope, and a sealing area having a like plurality of registration-affording V-grooves in alignment with the first V-grooves; and third, a like plurality of balls disposed between the mated first and second V-grooves for establishing precise registration between the faceplate and the frame in the process of screening a pattern of phosphor deposits on the target area and later in the final assembly of the tube. The assembly-in-process is characterized by the use of temporary cementing means for attaching the balls to either the first or second ones of the V-grooves, whereby the components-in-process can be reproducibly registered and re-registered in precise relationship during screening and later in final assembly of the tube. A method for use in manufacture is also disclosed.

4 Claims, 4 Drawing Figures

PROCESS OF MANUFACTURING FOR A HIGH-RESOLUTION COLOR CATHODE RAY TUBE

CROSS-REFERENCE TO RELATED APPLICATIONS

This application is related to but in no way dependent upon copending applications Ser. Nos. 538,001, now U.S. Pat. No. 4,593,224; Ser. No. 538,003 filed Sept. 30, 1983 and now abandoned; Ser. No. 572,088 now U.S. Pat. No. 4,547,696; and Ser. No. 572,089 now U.S. Pat. No. 4,595,857; Ser. Nos. 646,861 and 646,862, now U.S. Pat. Nos. 4,614,892 and 4,593,225; Ser. No. 729,020 now U.S. Pat. No. 4,652,791; Ser. No. 725,040, now U.S. Pat. No. 4,656,388, Ser. No. 725,040, now U.S. Pat. No. Des. D289,398; Ser. No. 727,486, filed Apr. 26, 1985; Ser. No. 729,015, filed Apr. 29, 1985; and Ser. No. 758,174 filed July 23, 1985, all of common ownership herewith.

BACKGROUND OF THE INVENTION

This invention relates generally to cathode ray picture tubes and is specifically addressed to a novel processing means for high-resolution cathode ray tubes having shadow masks of the tensed foil type. The invention has particular utility in the faceplate screening process.

A high-resolution color cathode ray tube that utilizes a tensed foil shadow mask typically includes three electron guns arranged in a delta or in-line configuration. Each gun projects an electron beam through the assigned apertures of a shadow mask, also called a "color selection electrode," onto a target area on the inner surface of the faceplate. The target area comprises a pattern of phosphor deposits arranged in groups of triads of dots. Each of the triads consists of a dot of a red-, green-, and blue-light-emitting phosphor. To improve the brightness of the display and to minimize the incidence of color impurities which can result if a beam falls upon an improper phosphor deposit, the target area may include a layer of a darkish light-absorbing material called a "grille" that surrounds and separates each of the dots. This type of screen is known as a "matrix" or "black surround" screen. Alternately, the phosphor and grille deposits on the target surface may comprise a plurality of vertically oriented, spaced rectangles in coordinate relationship to apertures in the form of rectangles or "slots" in the shadow mask. Tubes of this type are referred to as "slot mask tubes," in contrast to the "dot screen" types of tubes.

The phosphor pattern, whether dots, or stripes, is typically formed by a direct photoprinting process. The target area is first coated with a photosensitive slurry comprising phosphor particles of one of the three phosphors described. The shadow mask, mounted in a frame, is temporarily installed in precise relationship to the faceplate, and the coating is exposed to actinic light projected through the apertures of the mask from a light source located at a position that corresponds to the beam-emission point of the related electron gun. The faceplate is separated from the shadow mask and the coating is "developed" to remove unexposed portions. The result is a pattern of dots or stripes capable of emitting light of one color, whether red, green or blue. The mask is then reregistered with the faceplate, and the steps are repeated for each of the remaining colors to deposit triads of phosphor deposits on the target area on the faceplate in coordinate relationship with each aperture of the mask. A further step, usually taken before the deposition of the phosphors, is the application of the black surround.

The screening process requires a mechanism whereby the faceplate may be removed and replaced in precise registration with the shadow mask for the black surround and each of the three colors. The conventional "domed" shadow mask, which is mounted on a stiff frame, is made repeatably registrable with the phosphor deposits screened on the faceplate by a suspension system comprising three or four leaf springs. The springs are spot welded to the mask frame at selected points around its periphery. The distal ends of the springs are apertured to engage studs which project inwardly from the rearwardly extending flange of the tube faceplate. Demounting the mask is accomplished by depressing the springs to disengage the studs, and separating the panel from the mask frame, usually by automatic machinery. In the remounting, following the deposition of a phosphor, the mask and faceplate are again brought into propinquity whereby the springs are caused to re-engage the studs. This process does not lend itself to the screening of a tube that utilizes a foil mask (which is the subject of this application) because of the lack of structural strength of the very thin foil and the very different structures used to support it within the bulb. Therefore, a different means of mask-faceplate referencing is required for tension-mask tubes.

A major problem in manufacturing a color tube with a foil-type shadow mask is the difficulty in re-aligning the panel with the mask accurately enough to maintain registration between the mask apertures and the associated phosphor deposits. In this type of mask, there is a need for greater precision in registration. Foil mask thickness is typically in the range of 0.0002 to 0.002 mils, and the diameter of the apertures in a dot screen tube is about 0.0035 inch. The "pitch" (distance between aperture centers) for use in a high-resolution display may be, for example, 0.3 millimeters, and for very high resolution tubes, 0.2 millimeters or 0.15 millimeters or less. With regard to the Q-distance, this measurement is a function of the pitch of the shadow mask. For example, for a given gun design, if the pitch is 0.3 millimeters, the Q-distance may be, by way of example, 0.330 inch. For the very high resolution pitch of 0.2 millimeters, the Q-distance may be about 0.210 inch. These values dictate the need for great precision in the registration and re-registration of the mask and faceplate. For example, a tolerance of $\pm 0.0006$ inch in mask-faceplate registration is acceptable in the manufacture of conventional standard resolution cathode ray tubes having the domed mask. In the manufacture of the high resolution tension mask tubes with which this invention is concerned, however, the allowable tolerance is about $\pm 0.0002$ inch. If this tolerance is exceeded, color purity can be degraded.

OBJECTS OF THE INVENTION

It is a general object of the invention to provide an improved process for use in the manufacture of high-resolution cathode ray tubes.

It is another general object of the invention to provide an improved process for use in the manufacturing of color cathode ray tubes utilizing tensed foil shadow masks.

It is a more specific object of the invention to provide an novel process for facilitating the establishment of precise, repeatable registration between the shadow mask and screen of color cathode ray tubes that utilize the tensed foil shadow mask.

It is a specific object of the invention to provide component-in-process and assembly-in-process means for use in the manufacture of high-resolution tensed-mask color cathode ray tubes.

It is another specific object of the invention to provide a novel improvement in the referencing method for use in the manufacture of imaging screens for high-resolution tensed-mask color cathode ray tubes.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIG. *3a* shows the application of cement 55 to the indexing ball 54 as a preapplied coating.

DESCRIPTION OF THE PREFERRED EMBODIMENT

The invention is for use in the manufacture of a high-resolution color cathode ray tube having a tensed foil shadow mask. An assembly-in-process according to the invention comprises three components-in-process, as described in the following.

Figure 1:
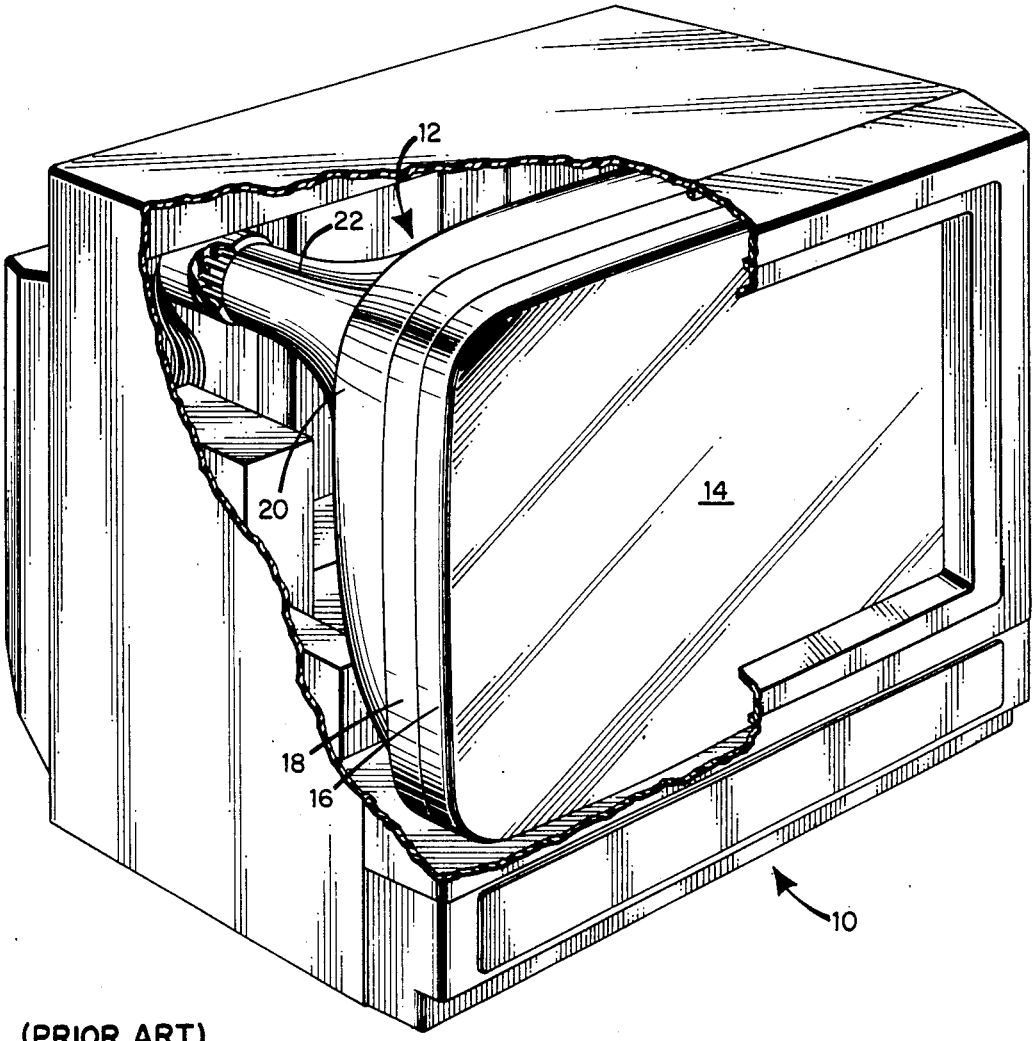
(PRIOR ART) Fig. 1.
FIG. 1 is a cut-away view in perspective of a prior art cabinet that houses a high-resolution color cathode ray tube, showing certain major components which may be assembled by the process according to the invention.
Figure 2:
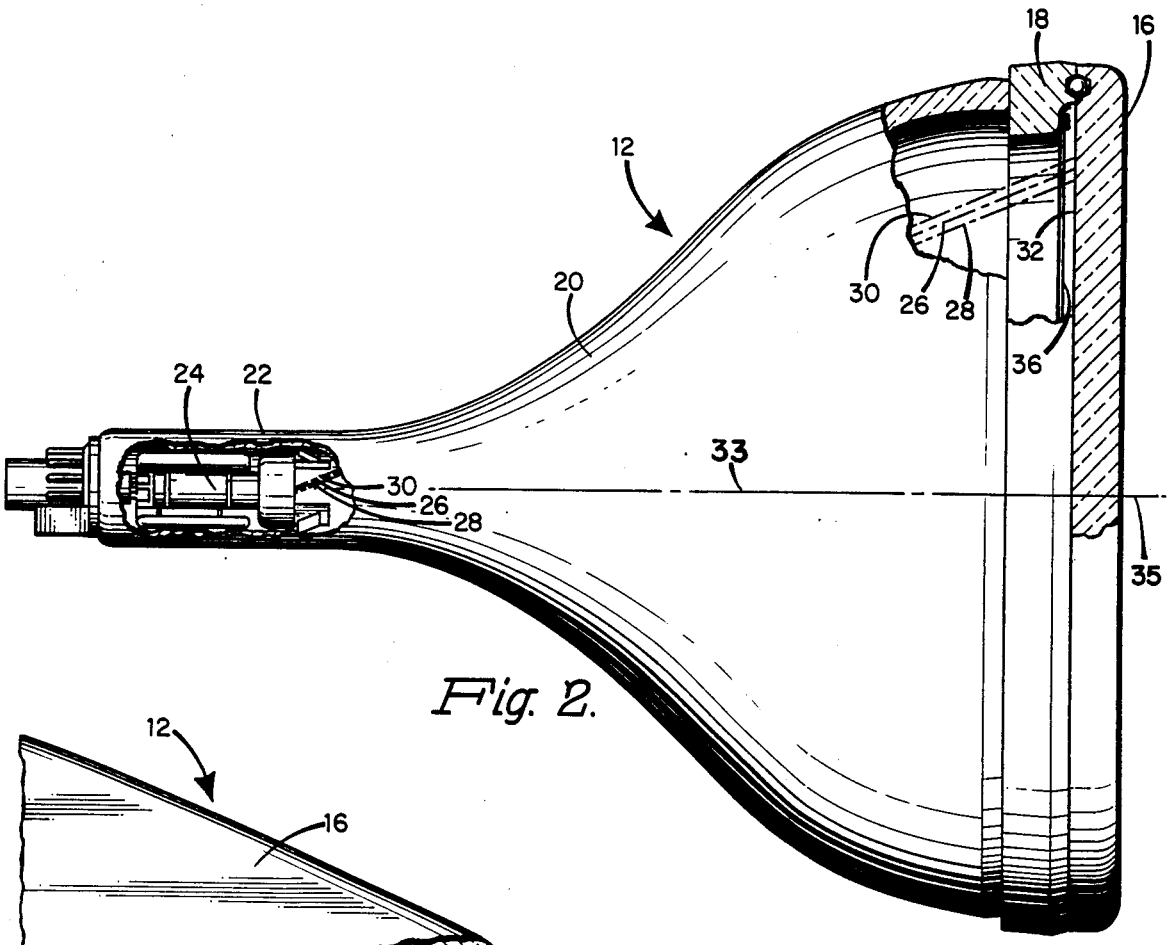
FIG. 2 is a side view in elevation of the color cathode ray tube of FIG. 1 showing another view of the components depicted in FIG. 1.

FIG. 1 shows a novel video monitor 10 that houses a high-resolution color cathode ray tube 12, certain components of which can be manufactured according to the present invention. The tube 12 and its components as depicted in FIGS. 1 and 2 constitute prior art of common ownership herewith provided by way of background so the present invention can best be understood. Various features and improvements of the tube 12 are illustrated and described in the referent copending applications assigned to the assignee of the present invention. The design of the monitor is the subject of copending design patent application Ser. No. 725,040 of common ownership herewith. The monitor, and the associated tube, is notable not only for high resolution, but also for the flat imaging area 14 that makes possible the display of images in undistorted form. Imaging area 14 also offers a more complete picture as the corners are relatively square in comparison with the more rounded corners of the conventional cathode ray tube.

High-resolution cathode ray tube 12 is shown in FIGS. 1 and 2 as having a flat glass faceplate 16. Faceplate 16, which comprises a first component-in-process is depicted as being joined to a color selection electrode frame 18 which in turn is joined to a rear envelope section, here shown as a funnel 20 which tapers down to a narrow neck 22. Neck 22 is shown in FIG. 2 as enclosing an electron gun 24 which is indicated as projecting three electron beams 26, 28 and 30 on the target area 32 of faceplate 16. Target area 32 receives at least one pattern of phosphor deposits, and typically has a pattern of triads of red-emitting, green-emitting, and blue-emitting phosphor deposits which emit light when energized by respective ones of the electron beams 26, 28 and 30. Reference No. 33 indicates the anterior-posterior axis of tube 12 that passes through the centerpoint 35 of the faceplate 16.

Figure 3:
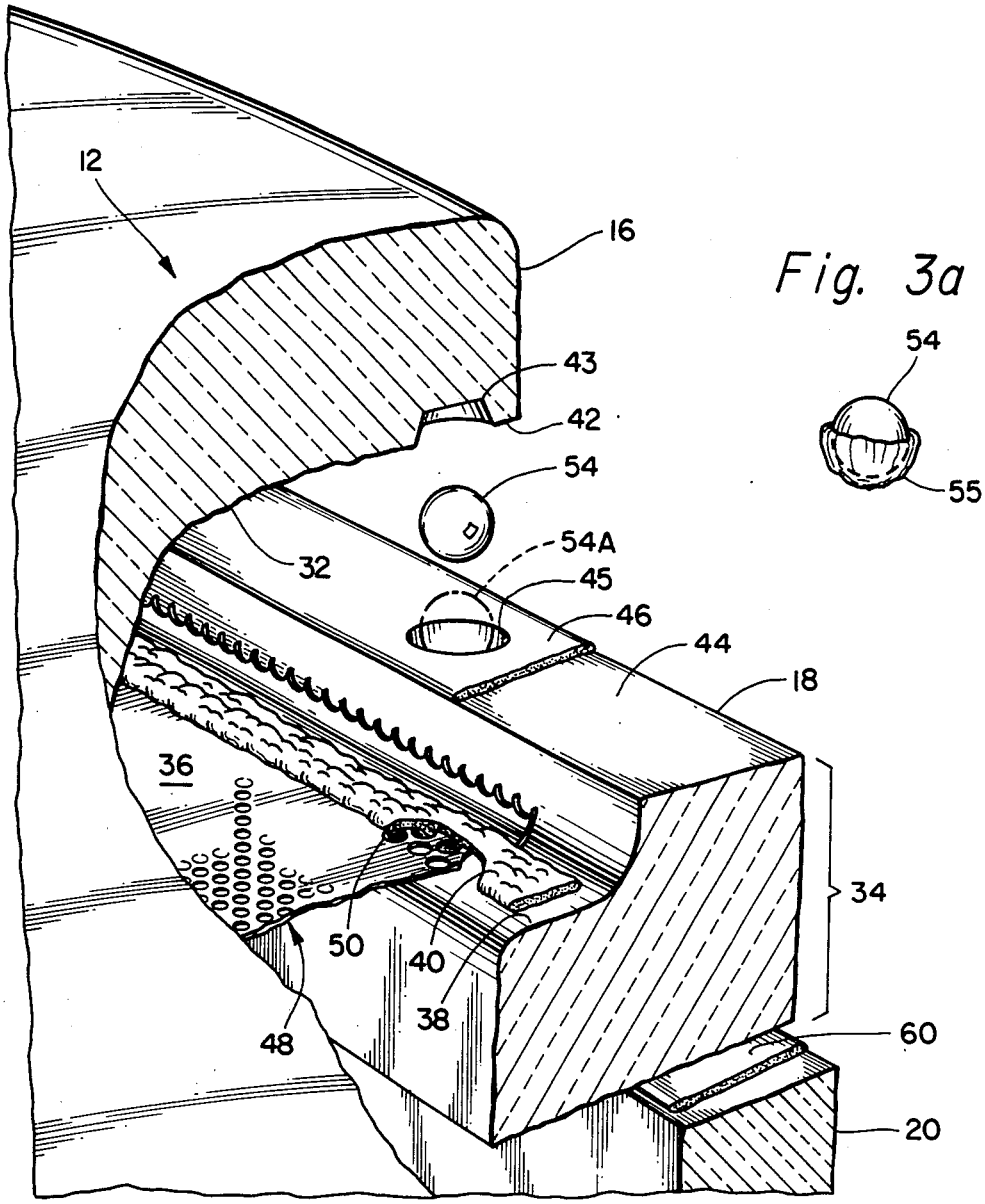
FIG. 3 is an enlarged cut-away exploded view in perspective of a section of the tube of FIG. 2 showing details of the relationship of the components-in-process according to the invention.

With additional reference to FIG. 3, a second component-in-process comprising a shadow mask support assembly 34 is shown which has the aforementioned frame 18 that ultimately constitutes a part of the tube envelope. The frame 18 of assembly 34 supports in tension the thin foil shadow mask 36. The tensed mask 36 is spaced a predetermined "Q" distance from the target area 32 of faceplate 16. The mask will be noted as being flat and parallel with target area 32. FIG. 3 shows the attachment of mask 36 to a peripherally continuous recessed support surface 38 located on frame 18; attachment is indicated as being by means of a layer of cement 40.

Shadow mask 36 is shown as having a first field of apertures 48 therein which provide for color selection in the finished tube, and a second field of apertures 50 peripheral to the first field. Peripheral apertures 50 comprise cement-passing apertures sized to pass cement in its viscous state. The cement can be the heretofore-described devitrifying glass frit. The embodiment of the shadow mask 36 as shown is not the subject of the present application, but is fully described and claimed in referent copending application Ser. No. 729,020.

Faceplate 16 has a sealing surface 42 circumscribing target area 32 of faceplate 16. Sealing surface 42 has a plurality of first V-grooves 43 selectively located thereon, one of which is shown by FIG. 3. Each of the indexing elements has an indexing groove therein which is "radially oriented"; that is, the long axis of each indexing groove is oriented to pass through center point 35 of faceplate 16 (as has been noted, the axis 33 of tube 12 passes through center point 35).

The shadow mask support assembly 34 is depicted as having a sealing area 44 that circumscribes target area 32 of faceplate 16. Sealing area 44 geometrically matches the faceplate sealing area 42. Faceplate sealing area 42 has a like plurality of radially oriented second registration-affording V-grooves 45 selectively located in alignment with the first V-grooves 43 which are located on the faceplate sealing surface 42.

Figure 4:
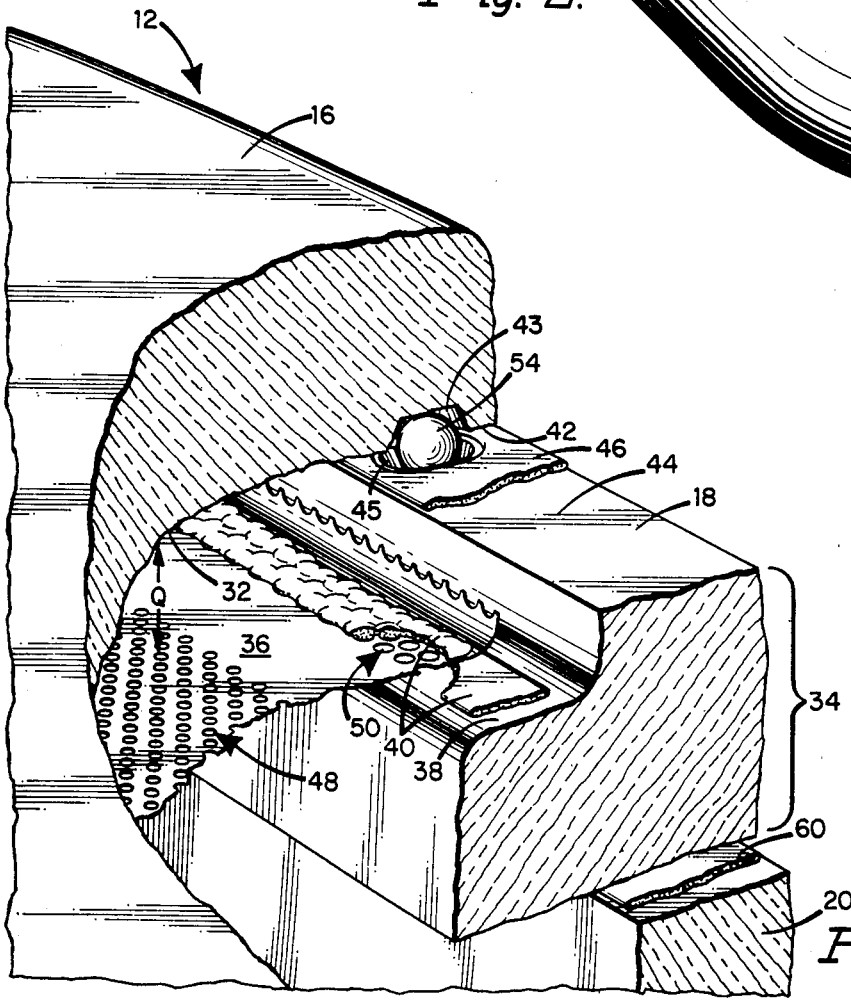
FIG. 4 is an enlarged cut away view of the section of the tube shown by FIG. 3, in final assembly.

A third component-in-process comprises a like plurality of balls; one of the balls 54 is shown by FIG. 3. As indicated by FIG. 4, which depicts the final assembly of the tube, the balls (only one ball 54 of which is shown with respect to V-grooves 43 and 45) are disposed between the mated first and second registration-affording V-grooves of the first and second components-in-process. The objective is to establish precise registration between the faceplate 16 and frame 18 in the process of screening the patterns of phosphor deposits on target area 32 on faceplate 16. Precise registration is also required "later" (that is, after screening has been completed) in the final assembly of the tube 12.

As noted in the background section, the faceplate and the screen must be precisely registered in temporary assembly for the repetitive process of screening each pattern of phosphor deposits on the target area and later in the final assembly of the tube. With reference to FIG. 4, the exploded section of the cathode ray tube shown by FIG. 3 is indicated as being finally assembled; that is, the tube envelope is permanently bonded into an integral entity from which air can be evacuated (A cathode ray tube assembled in toto is depicted in FIG. 2.)

The assembly-in-process according to the invention is characterized by temporary means for attaching the indexing balls in the respective V-grooves, as shown by ball 54, indicated in FIG. 3 by the dash-line depiction 54A as being temporarily attached to V-groove 45. Locating of the balls in the grooves of the frame 18 rather than faceplate 16 is preferable as screening is typically accomplished with the "light house" oriented vertically. As a result, the faceplate 16 can be placed on "top" of frame 18 where it will remain, being held down by the force of gravity.

In the preferred embodiment of the assembly-in-process, the balls can be temporarily cemented in place according to the invention by a vitreous frit cement. A vitreous frit cement is a compound of glass that melts when heated to an elevated temperature, and becomes a solid again when cooled. A divitrifying frit on the other hand first melts, then crystallizes at the melting temperature to become a solid glass adhesive or cement—a state in which it continues whether in a heated or a cooled state.

The vitreous frit used for temporary attachment of the balls according to the invention preferably melts at a lower temperature than the temperature at which the devitrifying frit cement begins to crystallize and become an adhesive cement. A suitable vitreous frit cement is manufactured by Corning of Corning, N.Y. under the designation of XG702. This vitreous cement provides broad melt endotherm centered around 340 degrees centigrade, and does not devitrify even at an elevated temperature of 440 degrees centigrade. The devitrifying frit cement is preferably one that devitrifies at a temperature of about 430 degrees centigrade; one such type is manufactured by Owens-Illinois under their designation CV-130.

Alternately, the cement for temporary attachment of the balls according to the invention may comprise an organic cement. For this application, an organic cement must be easy to apply, and quickly adhesive, or "set," following its application in liquid form. It must remain adherent at least up to a temperature of 300 degrees centigrade, and it must "burn out" or otherwise dissipate without leaving a residue. (It is to be noted that all organic cements will burn out at elevated temperatures; however, many will also leave an undesired residue.) Additionally, the organic cement should remain somewhat flexible and yielding after it sets up to obviate fracturing of the balls during registration.

By way of example, an organic cement that meets the major requirements is cyanoacrylate, colloquially known as "super-glue." The supplier is Eastman Kodak, Rochester, N.Y. An equivalent of another manufacturer may be used provided it has characteristics identical to those set forth in the foregoing paragraph.

The method for using an organic cement for the temporary cementing of the balls according to the invention comprises:

(a) applying a predetermined amount of a liquid organic cement to ones of either the first or second registration affording V-grooves on the frame;
(b) inserting ones of the balls in the cement-containing V-grooves;
(c) positioning the faceplate and the shadow mask support assembly with the ball-and-groove means in mating conjunction such that the faceplate and the frame are in precise registration;
(d) allowing the organic cement to become adhesive to temporarily cement the balls to the cement-containing V-grooves;
(e) alternately installing and removing the faceplate with respect to the frame in the process of repetitively photoscreening the faceplate;
(f) removing the faceplate and applying a devitrifying frit in paste form to the sealing areas and the V-grooves and balls;
(g) repositioning the faceplate and the shadow mask support assembly in precise registration;
(h) reheating the assembly to first dissipate the organic cement and allow the balls to roll freely in the grooves for proper indexing, and secondly to devitrify the devitrifying frit and thus permanently bond the faceplate and the frame in precise registration.

The application of the vitreous frit cement or an organic cement according to the invention is as indicated in FIG. 3. As shown by the insert, a coating of cement 55 may be applied to the lower portion of ball 54 before ball 54 is lowered into V-groove 45, as depicted by the dash-line configuration 54A of ball 54. In the preferred embodiment, the cement is applied to the V-grooves (not depicted).

Frit cements are usually compounded in paste form for application, which is usually by brush, or by roller means, in automated production. The viscosity and texture is similar to toothpaste.

The method according to the invention for use in the manufacture of a high-resolution color cathode ray tube, when utilizing a vitreous frit cement as the temporary cementing means, comprises (a) applying a predetermined amount of vitreous frit cement in paste form to ones of either the first or second registration affording V-grooves on the frame;
(b) inserting ones of the balls in the frit-cement containing V-grooves;
(c) positioning the faceplate and the shadow mask support assembly with the ball-and-groove means in mating conjunction such that the faceplate and the frame are in precise registration;
(d) heating and cooling the assembled faceplate and shadow mask support frame to first liquify and then solidify the vitreous frit cement to temporarily cement the vitreous-cement containing the V-grooves;
(e) alternately installing and removing the faceplate with respect to the frame in the process of repetitively photoscreening the faceplate;
(f) applying a divitrifying frit to the sealing areas and the V-grooves and balls;
(g) repositioning the faceplate and the shadow mask support assembly in precise registration;
(h) reheating the assembly to devitrify the devitrifying frit and permanently bond the faceplate and the frame in precise registration.

As noted in the background section, the faceplate and the frame must be precisely registered in temporary assembly for the repetitive process of screening each pattern of phosphor deposits on the target area and later in the final assembly of the tube. With reference to FIG. 4, the section of the cathode ray tube shown is indicated as being finally assembled; that is, the tube envelope is permanently bonded into an integral entity from which air can be evacuated. (A cathode ray tube assembled in toto is depicted partly cut away in FIG. 2). Faceplate 16 is indicated as being bonded to frame 18 by a layer of devitrifying frit 46. A bead of devitrifying frit 40 is used for attaching the shadow mask 36 to sealing surface 38 of frame 18, and another layer of frit 60, provides for attaching frame 18 to funnel 20. The benefits of the inventive means and method include: (a) the balls remain fixed in proper registry, and there is no need to reposition them for each screening; (b) the balls cannot be lost in the production process; (c) when screening is completed, the balls are in situ for fritting into the envelope; and, (d) the balls will be able to roll freely in the grooves without the friction which would prevent proper registry in final assembly of the tube.

The means and method according to the invention have efficacy when applied to those of the referent copending applications that utilize ball-and-groove indexing means, including Ser. Nos. 538,001; 572,088; 572,089; 729,015; 735,887; 727,486; and 758,174.

While a particular embodiment of the invention has been shown and described, it will be obvious to those skilled in the art that changes and modifications may be made in the inventive means and method without departing from the invention in its broader aspects, and therefore, the aim in the appended claims is to cover all such changes and modifications as fall within the true spirit and scope of the invention.

What is claimed is:

1. For use in a highresolution color cathode ray tube, a front assembly comprising:

a faceplate with a target area for receiving at least one pattern of phosphor deposits, said faceplate having a sealing area circumscribing said target area including a plurality of first substantially radially oriented registration-affording V-grooves selectively oriented thereon;

a shadow mask support assembly having a frame ultimately constituting a part of the tube envelope supporting a tensed foil shadow mask in precise adjacency to said target area, said frame having a sealing area geometrically matching said faceplate sealing area, and which has thereon a like plurality of second substantially radially oriented registration-affording V-grooves selectively located in alignment with said first V-grooves on said sealing area of said faceplate; and a like plurality of balls disposed between the mated first and second registration affording V-grooves of said faceplate and said frame for establishing precise registration between said faceplate and said shadow mask in the process of screening said pattern of phosphor deposits on said target area and later in the final assembly of said tube;

said faceplate assembly having a first cement composed of a vitrifying cement in the regions of said mated registration-affording V-grooves, and a second cement composed of a divitrifying cement elswhere in said sealing area for permanent bonding of said faceplate and said frame, said vitrifying cement softening at a temperature below the divitrifying temperature of said devitrifying cement.

2. A method for use in the manufacture of a high-resolution color cathode ray tube having a tensed foil shadow mask, said tube including:

a faceplate with a target area for receiving at least one pattern of phosphor deposits, said faceplate having a sealing area circumscribing said target area with a plurality of first substantially radially oriented registration-affording V-grooves selectively oriented thereon;

a shadow mask support assembly having a frame ultimately constituting a part of the tube envelope for supporting said shadow mask in precise adjacency to said target area, said sealing area circumscribing said target surface and geometrically matching said faceplate sealing area, said faceplate sealing area having a like plurality of second substantially radially oriented registration-affording V-grooves selectively located in alignment with said first V-grooves on said sealing area of said faceplate; and, a like plurality of balls for insertion between the first and second registration affording V-grooves of said faceplate and said frame for establishing precise registration between said faceplate and said frame in the process of screening said pattern of phosphor deposits on said target area and later in the final assembly of said tube;

the method comprising:

applying a predetermined amount of vitreous frit cement in paste form to ones of either said first or second registration affording V-grooves on said frame;

inserting ones of said balls in the vitreous-frit-cement-containing V-grooves;

positioning said faceplate and said shadow mask support assembly with said ball-and-groove means in mating conjunction such that said faceplate and said frame are in precise registration;

heating and cooling the assembled faceplate and shadow mask support frame to first liquify and then solidify said vitreous frit cement to temporarily cement said balls to said vitreous-frit-cement-containing V-grooves;

alternately installing and removing said faceplate with respect to said frame in the process of repetitively photoscreening said faceplate;

removing said faceplate and applying a divitrifying frit cement in paste form to said sealing areas and said V-grooves and balls;

repositioning said faceplate and said shadow mask support assembly in precise registration;

reheating said assembly to first melt said vitrifying frit cement and allow said balls to roll freely in said grooves for proper indexing, and secondly to devitrify said devitrifying frit cement and thus permanently bond said faceplate and said frame in precise registration.

3. A method for use in the manufacture of a high-resolution color cathode ray tube having a tensed foil shadow mask, said tube including:

a faceplate with a target area for receiving at least one pattern of phosphor deposits, said faceplate having a sealing area circumscribing said target area with a plurality of first substantially radially oriented registration-affording V-grooves selectively oriented thereon;

a shadow mask support assembly having a frame ultimately constituting a part of the tube envelope for supporting said shadow mask in precise adjacency to said target area, said sealing area circumscribing said target surface and geometrically matching said faceplate sealing area, said faceplate sealing area having a like plurality of second substantially radially oriented registration-affording V-grooves selectively located in alignment with said first V-grooves on said sealing area of said faceplate; and, a like plurality of balls for insertion between the first and second registration affording V-grooves of said faceplate and said frame for establishing precise registration between said faceplate and said frame in the process of screening said pattern of phosphor deposits on said target area and later in the final assembly of said tube;

the method comprising:

applying a predetermined amount of a liquid organic cement free of frit to ones of either said first or second registration affording V-grooves on said frame;

inserting ones of said balls in the cement-containing V-grooves;

positioning said faceplate and said shadow mask support assembly with said ball-and-groove means in mating conjunction such that said faceplate and said frame are in precise registration;

allowing said organic cement to become adhesive to temporarily cement said balls to said cement-containing V-grooves;

alternately installing and removing said faceplate with respect to said frame in the process of repetitively photoscreening said faceplate;

removing said faceplate and applying a devitrifying frit cement to said sealing areas and said V-grooves and balls;

repositioning said faceplate and said shadow mask support assembly in precise registration;

reheating said assembly to first dissipate said organic cement and allow said balls to roll freely in said grooves for proper indexing, and secondly to devitrify said devitrifying frit and thus permanently bond said faceplate and said frame in precise registration.

4. For use in a high-resolution color cathode ray tube, a front assembly comprising:

a faceplate with a target area for receiving at least one pattern of phosphor deposits, said faceplate having a sealing area circumscribing said target area including a plurality of first substantially radially oriented registration-affording V-grooves selectively oriented thereon;

a shadow mask support assembly having a frame ultimately constituting a part of the tube envelope supporting a tensed foil shadow mask in precise adjacency to said target area, said frame having a sealing area geometrically matching said faceplate sealing area, and which has thereon a like plurality of second substantially radially oriented registration-affording V-grooves selectively located in alignment with said first V-grooves on said sealing area of said faceplate; and a like plurality of balls disposed between the mated first and second registration-affording V-grooves of said faceplate and said frame for establishing precise registration between said faceplate and said shadow mask in the process of screening said pattern of phosphor deposits on said target area and later in the final assembly of said tube, said faceplate assembly having a first cement composed of an organic cement free of frit in the regions of said mated registration-affording V-grooves, and a second cement composed of a devitrifying cement elswhere in said sealing area for permanent bonding of said faceplate and said frame, said organic cement dissipating at a temperature below the devitrifying temperature of said devitrifying cement.

* * * * *